United States Patent [19]

Lu

[11] Patent Number: 4,647,522

[45] Date of Patent: Mar. 3, 1987

[54] TONER COMPOSITIONS CONTAINING CERTAIN CLEANING ADDITIVES

[75] Inventor: Chin H. Lu, Fremont, Calif.

[73] Assignee: Xerox Corporation, Stamford, Conn.

[21] Appl. No.: 690,902

[22] Filed: Jan. 14, 1985

[51] Int. Cl.[4] ..... G03G 9/08; G03G 9/10

[52] U.S. Cl. ..... 430/110; 430/109

[58] Field of Search ..... 430/110

[56] References Cited

U.S. PATENT DOCUMENTS

| | | | |
|---|---|---|---|
| 3,720,617 | 3/1973 | Chatterji et al. | 430/110 |
| 3,900,588 | 8/1975 | Fisher | 427/19 |
| 3,983,045 | 9/1976 | Jugle et al. | 430/110 |
| 4,288,516 | 9/1981 | Gaudioso | 430/107 |
| 4,301,228 | 11/1981 | Kori et al. | 430/122 |
| 4,345,015 | 8/1982 | Hendriksma et al. | 430/137 |
| 4,395,485 | 7/1983 | Kashiwagi et al. | 430/903 |
| 4,430,409 | 2/1984 | Matsumoto et al. | 430/110 X |

*Primary Examiner*—Roland E. Martin

*Attorney, Agent, or Firm*—E. O. Palazzo

[57] ABSTRACT

A toner composition consisting essentially of resin particles, pigment particles, and oxide particles selected from the group consisting of individual additive particles of silicon oxides, aluminum oxides, and titanium oxides, which particles are prepared by a precipitation process and are of a diameter of from about 10 millimicrons to about 40 millimicrons.

12 Claims, No Drawings

TONER COMPOSITIONS CONTAINING CERTAIN CLEANING ADDITIVES

BACKGROUND OF THE INVENTION

This invention is generally directed to toner compositions, and more specifically, the present invention is directed to developer compositions and toner compositions having incorporated therein specific additives. More specifically, the present invention relates to the incorporation into toner compositions of specific oxides prepared by a precipitation process rather than the flame hydrolysis methods of the prior art. These toner compositions, which have improved admix properties, excellent flow characteristics, superior developability, and humidity insensitivity enable their use in xerographic imaging, and printing processes.

Toner compositions with additives therein are known. There is described, for example in U.S. Pat. No. 3,983,045, toner compositions having incorporated therein additives of silicon dioxide, and metal salts of a fatty acid. According to the teachings of this patent, the silica particles are added for the purpose of cleaning the imaging member thus preventing lubricants such as zinc stearate from adhering thereto. The silicon oxide particles utilized are prepared by a flame hydrolysis process resulting in material of a diameter of from about 10 to about 30 millimicrons. These particles are spherical in shape, however, they are sintered together causing chains and aggregates to form. Accordingly, the resulting particles are difficult to disperse in the toner compositions; and further, they are, in many instances, humidity sensitive. Also, the silica particles prepared by the flame hydrolysis method have a tendency to adhere to the surface of carrier particles thereby resulting in undesirable charge polarity of the wrong sign to be generated on the toner particles. Therefore, developer compositions with these additives therein can generate low optical density images, high image background deposits, and low toner concentration latitudes at certain relative humidities. These problems are eliminated with the toner compositions of the present invention.

Additionally, disclosed in U.S. Pat. No. 3,320,169 is a developer composition comprised of three components, namely magnetic carrier particles, and toner particles consisting of a discrete mixture of pigmented resin particles in an aliphatic acid having from about 10 to 26 carbon atoms, and/or salts of such aliphatic acids. Examples of fatty acids disclosed include saturated or unsaturated acids with from 10 to 26 carbon atoms such as lauric, stearic, oleic, and the like. It is known that other additives, including colloidal silicas, can be included in these toner compositions.

Furthermore, described in U.S. Pat. No. 3,900,588 are developer compositions comprised of toner resin particles and a dual additive of a substantially smearless polymeric additive in a finely divided abrasive material. Examples of smearless polymeric substances that may be selected include polyvinylidene fluoride, and other similar polymers, reference the disclosure in column 5, beginning at line 51. Abrasive materials that may be selected for incorporation into the toner composition of the '588 patent include colloidal silicas, reference the disclosure in column 7, beginning at around line 11. It is further indicated in this patent that the particle size of the abrasive additive should be from about 1 to about 50 millimicrons, and preferably between about 10 to about 100 millimicrons. Additionally, the use of hydrophobic silica particles in affecting the dispersion polymerization of toner compositions is disclosed in U.S. Pat. No. 4,345,015. Other patents disclosing the use of silicas in toner compositions, which silicas are prepared by a flame hydrolysis process, are U.S. Pat. Nos. 4,301,228; 4,288,516; and 4,395,485.

Moreover, there is described in U.S. Pat. No. 2,986,521 reversal developer compositions comprised of toner resin particles coated with finely divided colloidal silica compositions. According to the disclosure of this patent, the development of electrostatic latent images on negatively charged surfaces is accomplished by applying a developer composition with a positively charged triboelectric relationship with respect to the colloidal silica.

Additionally, there is disclosed in U.S. Pat. No. 4,298,671 positively charged toner compositions with resin particles and pigment particles, and as a charge enhancing additive alkyl pyridinium compounds and their hydrates of the formula as detailed in column 3, beginning at line 14. Examples of alkyl pyridinium compounds disclosed include cetyl pyridinium chloride. These toner compositions can have incorporated therein additive particles of silicon oxide prepared by the flame hydrolysis process.

There is also disclosed in a copending application developer compositions comprised of a mixture of resin particles, additive particles of silica oxides, additive particles of a metal salt of a fatty acid, and uncoated ferrite carrier particles. The silica particles selected for this developer composition are prepared by a flame hydrolysis process, therefore, difficulties can be encountered in dispersing these particles in toner resin compositions.

These prior art toner compositions in some instances possess narrow toner concentration latitudes; high concentration of wrong sign toner particles; slow admix properties; developed images with high background; and undesirable humidity sensitivity, problems overcome with the toner; and developer compositions of the present invention.

SUMMARY OF THE INVENTION

It is an object of the present invention to provide toner and developer compositions which overcome some of the above-noted disadvantages.

In another object of the present invention there are provided toner compositions useful for causing the development of electrostatic latent images including color images.

In yet another object of the present invention there are provided toner compositions with improved admix characteristics, and improved humidity sensitivity.

In yet another object of the present invention there are provided toner compositions containing therein as additive particles certain oxides obtained from a precipitation process.

In still another object of the present invention there are provided toner compositions containing therein as additive particles silica oxides obtained from a precipitation process.

In still another object of the present invention there are provided toner compositions having suitably dispersed therein additive particles of specific oxide obtained from a precipitation process.

In another object of the present invention there are provided toner compositions having suitably dispersed therein additive particles of silicon oxides obtained from a precipitation process.

In a further object of the present invention there is provided an imaging process with toner compositions having suitably dispersed therein additive particles of specific oxides obtained from a precipitation process.

In a further object of the present invention there is provided an imaging process with toner compositions having suitably dispersed therein additive particles of titanium oxides, aluminum oxides, and alkali metal carbonates obtained from a precipitation process.

In a final object of the present invention there are provided toner compositions with improved admix properties, substantially no concentrations of wrong sign toners, and low image backgrounds subsequent to development.

These and other objects of the present invention are accomplished by providing developer compositions, and toner compositions wherein the dry electrostatic toner compositions are comprised of resin particles, especially first resin particles and second resin particles, pigment particles, and additive particles. More specifically, there are provided in accordance with the present invention toner compositions comprised of toner resin particles, pigment particles, and additive particles selected from the group consisting of oxides and alkali metal carbonates prepared from a precipitation process. Also, the toner compositions of the present invention can have incorporated therein as further additive particles, metal salts of a fatty acid.

In one embodiment of the present invention there are provided toner compositions comprised of first toner resin particles of styrene methacrylate copolymers, or related copolymers, grafted with or containing a low molecular weight wax; second toner resin particles of terpolymers of styrene, acrylate, and acrylonitrile; pigment particles; and additive particles generated from a precipitation process and not by a flame hydrolysis method, which additives are selected from the group consisting of silicon oxides, aluminum oxides, and titanium oxides. These additives are of a small particle size, that is, from about 1 to about 100 millimicrons; and preferably of from about 10 to about 40 millimicrons; and further are of an irregular shape. The additive particles, which may be optionally treated with silane compounds such as dimethyldichlorosilane to render the surface thereof hydrophobic, can be loosely adhered to the toner resin surface by known blending processes; or they may be firmly anchored to the surface of the toner by high energy blending methods, and/or heat treatments, in amounts of from about 0.1 percent by weight to about 10 percent by weight, and preferably in an amount of from about 0.1 percent by weight to about 3 percent by weight. Further, these additive particles exist as separate components, and are not sintered together in the form of chains, or networks. It is believed that the additive particles of the present invention, which are available from Degussa Corporation are prepared by a precipitation process of an alkaline silicate with acids such as sulfuric acid followed by spray drying. The prior art flame hydrolysis silica additives are also available from Degussa.

The aforementioned first resin particles, particularly first resin particles comprised of a styrene and butylmethacrylate copolymer resin, may be grafted with a low molecular weight wax, or contain a wax therein. In this embodiment, there are preferred styrene and butylmethacrylate copolymers containing from about 65 percent by weight of styrene and about 35 percent by weight of n-butyl methacrylate, or 58 percent by weight of styrene and about 42 percent of weight of n-butyl methacrylate. These styrene butylmethacrylate copolymers grafted with or containing a low molecular weight wax are available from Sanyo Company, Inc., a Japanese corporation.

Illustrative examples of second resin particles are terpolymer resins, believed to be crosslinked. These resins are commercially available from Nippon Zeon Company Ltd., a Japanese corporation. The terpolymer resins are believed to be comprised of a terpolymer of styrene; acrylate, such as butyl acrylate; and acrylonitrile. In one illustrative embodiment, it is believed that the terpolymer resin contains styrene in an amount of from about 55 percent by weight to about 60 percent by weight, butyl acrylate in an amount of from about 30 percent by weight to about 35 percent by weight, and acrylonitrile in an amount of from about 5 percent by weight to about 10 percent by weight.

The waxy material selected for the first resin particles is believed to have a molecular weight of from about 500 to about 20,000, and preferably of from about 1,000 to about 5,000. Illustrative examples of useful low molecular weight waxy materials include polypropylenes and polyethylenes commercially available from Allied Chemical and Petrolite Corporation; Epolene N-15, commercially available from Eastman Chemical Products Inc.; Viscol 550-P, a low molecular weight polypropylene available from Sanyo Kasei K.K., and similar materials. The commercially available polyethylenes selected have a molecular weight of from about 1,000 to about 1,500, while the commercially available polypropylenes incorporated into the toner compositions of the present invention are believed to have a molecular weight of from about 4,000 to about 5,000. Many of the polyethylene and polypropylene compositions useful in the present invention are illustrated in British Pat. No. 1,442,835.

The low molecular weight wax materials are present in the toner composition of the present invention in various amounts; however, generally these waxes are included in the toner composition in an amount of from about 1 percent by weight to about 10 percent by weight, and preferably in an amount of from about 2 percent by weight to about 5 percent by weight.

In one preferred embodiment of the present invention the first resin particles are present in the toner composition in an amount of from about 30 percent by weight to about 75 percent by weight, while the second terpolymer resin particles are present in an amount of from about 15 percent by weight to about 60 percent by weight. Developer compositions can thus be prepared which comprise from about 40 percent by weight to about 90 percent by weight, and preferably from about 70 percent by weight to about 90 percent by weight; of the first resin particles and the second resin particles, these developer compositions further including therein pigment particles, carrier particles, and additive particles.

Illustrative examples of suitable toner resins, inclusive of first resin particles, selected for the toner and developer compositions of the present invention include polyamides, epoxies, polyurethanes, vinyl resins and polymeric esterification products of a dicarboxylic acid and a diol comprising a diphenol. Suitable vinyl resins that may be selected for the aforementioned toner resins of the present application include homopolymers or copolymers of two or more vinyl monomers. Typical of such vinyl monomeric units are: styrene, p-chlorostyrene vinyl naphthalene unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters including esters of monocarboxylic acids like methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, and vinyl ethers; vinyl ketones such as vinyl methyl ketone, vinyl hexyl ketone, methyl isopropenyl ketone and the like; vinylidene halides inclusive of vinylidene chloride, and vinylidene chlorofluoride; styrene butadiene copolymers, and mixtures thereof.

As one specific toner resin there can be selected the esterification products of a dicarboxylic acid and a diol comprising a diphenol. The materials are illustrated in U.S. Pat. No. 3,590,000, the disclosure of which is totally incorporated herein by reference. Other preferred toner resins include styrene/methacrylate copolymers, and styrene/butadiene copolymers, polyester resins obtained from the reaction of bis-phenol A and propylene oxide, followed by the reaction of the resulting product with fumaric acid, and branched polyester resins resulting from the reaction of dimethylterephthalate, 1,3-butanediol; 1,2-propanediol; and pentaerythriol.

With respect to the embodiment of the present invention wherein there is present resin particles with no wax, various suitable amounts can be selected providing the objectives of the present invention are achieved. Accordingly, for example, when 10 percent by weight of pigment or colorant particles such as carbon black are present, about 85 to 88 percent by weight of resin material is selected. Generally, from about 0.1 weight percent to about 10 weight percent, and preferably from about 1 weight percent to about 3 weight percent of additive particles are selected for mixing with the toner particles, inclusive of first toner resins particles and second toner resin particles; however, these additives can be present in various other amounts providing the objectives of the invention are accomplished. The additives of the present invention can be blended into the toner composition, or coated on the pigment particles such as carbon black, which are used as the colorants in the developer composition.

Numerous well known suitable pigments or dyes can be selected as the colorant for the toner particles including, for example, carbon black, nigrosine dye, aniline blue, magnetites and mixtures thereof. The pigment, which is preferably carbon black, should be present in a sufficient amount to render the toner composition highly colored enabling the formation of a clearly visible image on a suitable recording member. Generally, the pigment particles are present in amounts of from about 3 percent by weight to about 20 percent by weight based on the total weight of the toner composition; however, lesser or greater amounts of pigment particles can be selected providing the objectives of the present invention are achieved.

When the pigment particles are comprised of magnetites, which are a mixture of iron oxides ($FeO.Fe_2O_3$) including those commercially available as Mapico Black, they are present in the toner composition in an amount of from about 10 percent by weight to about 70 percent by weight, and preferably in an amount of from about 20 percent by weight to about 50 percent by weight.

Also embraced within the scope of the present invention are colored toner compositions with toner resin particles, carrier particles, the additives illustrated herein, and as pigments or colorants, magenta, cyan, and/or yellow particles, as well as mixtures thereof. More specifically, with regard to the production of color images utilizing a developer composition of the present invention, illustrative examples of magenta materials that may be selected as pigments include, for example, 2,9-dimethyl-substituted quinacridone and anthraquinone dye identified in the color index as Cl 60710, Cl Dispersed Red 15, a diazo dye identified in the color index as Cl 26050, Cl Solvent Red 19, and the like. Illustrative examples of cyan materials that may be used as pigments include copper tetra-4(octadecyl sulfonamido)phthalocyanine, X-copper phthalocyanine pigment listed in the color index as Cl 74160, Cl Pigment Blue, and Anthrathrene Blue, identified in the color index as Cl 69810, Special Blue X-2137; while illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron yellow SE/GLN, Cl dispersed yellow 33, 2,5-dimethoxy-4-sulfonanilide phenylazo-4'-chloro-2,5-dimethoxy aceto-acetanilide, permanent yellow FGL, and similar substances. The cyan, magenta, and yellow pigments are generally present in the toner composition in an amount of from about 2 weight percent to about 15 weight percent based on the weight of the toner resin particles.

Illustrative examples of carrier particles that can be selected for mixing with the toner particles of the present invention include those particles that are capable of triboelectrically obtaining a charge of opposite polarity to that of the toner particles. Accordingly, the carrier particles of the present invention can be selected so as to be of a positve polarity in order that the toner particles which are negatively charged will adhere to and surround the carrier particles. Illustrative examples of carrier particles include methyl methacrylate, steel, nickel, iron, ferrites, silicon dioxide, and the like. Additionally, there can be selected as carrier particles nickel berry, reference U.S. Pat. No. 3,847,604, which carriers are comprised of nodular carrier beads of nickel characterized by surfaces of reoccurring recesses and protrusions thereby providing particles with a relatively large external area. These particles can be used with or without a coating, the coating generally being comprised of fluoropolymers such as polyvinylidenefluoride resins, terpolymers of styrene, methylmethacrylate, and vinyl triethoxy silane, tetrafluoroethylenes, other known polymeric coatings, and the like.

Carrier particle diameters can vary; generally however, this diameter is from about 50 microns to about 1,000 microns, allowing these particles to possess sufficient density and inertia to avoid adherence to the electrostatic images during the development process. The carrier particles can be mixed with the toner composition in various suitable combinations, however, best results are obtained when about 1 part per toner to about 10 parts to about 200 parts by weight of carrier are formulated.

The toner composition of the present invention can be prepared by a number of known methods, including melt blending the toner resin particles, pigment particles or colorants, and additives of the present invention followed by mechanical attrition. Other methods include those well known in the art such as spray drying, extrusion processing, melt dispersion, dispersion polymerization, and suspension polymerization. In one dispersion polymerization method, a solvent dispersion of the resin particles, the pigment particles, and the additives are spray dried under controlled conditions to result in the desired product. Toner compositions prepared in this manner result in a negatively charged toner composition in relation to the carrier materials selected, and these materials exhibit the improved properties as mentioned hereinbefore.

Also, the toner and developer compositions of the present invention may be selected for use in developing images in electrostatographic imaging systems, containing therein conventional photoreceptors providing that they are capable of being charged positively. This usually occurs with inorganic photoreceptors, illustrative examples of which include selenium, selenium alloys, inclusive of selenium tellurium, selenium arsenic, selenium arsenic tellurium, halogen doped selenium alloys, halogen doped amorphous selenium, and the like.

Furthermore, the toner and developer compositions of the present invention preferably include therein second additive particles of fatty acids or fatty acid salts, reference U.S. Pat. No. 3,320,169, the disclosure of which is totally incorporated herein by reference. These acids generally contain from about 10 to about 26 carbon atoms, and include lauric acid, palmitic acid, stearic acid, oleic acid, or the calcium, barium zinc, and nickel salts of these acids. Specific preferred metal fatty additives selected are zinc stearate and calcium stearate. Generally, these fatty acids or the metal salts thereof are present in an amount of from about 0.1 percent by weight to about 1 percent by weight, based on the weight of the toner particles; and preferably are present in an amount of from about 0.01 percent by weight to about 0.80 percent by weight. These additives, as well as the first resin particles and second resin particles useful for the toner compositions of the present invention, are described in copending application U.S. Ser. No. 501,666 entitled "Stable Conductive Developer Compositions", the disclosure of this copending application being totally incorporated herein by reference.

The following examples are being supplied to further define various species of the present invention, it being noted that these examples are intended to illustrate and not limit the scope of the present invention. Parts and percentages are by weight unless otherwise indicated.

EXAMPLE I

There was prepared a toner composition A by melt blending at a temperature of from about 90° to 100° C., followed by mechanical attrition; 10 percent by weight of Black Pearls 1300 carbon black obtained from Cabot Corporation; 22.5 percent by weight of a divinylbenzene crosslinked terpolymer resin of styrene, methylmethacrylate, and acrylonitrile; and 67.5 percent of a styrene methacrylate resin containing 80 percent by weight of styrene, and 20 percent by weight of methacrylate; and 7 percent by weight of a low molecular weight polypropylene, which resin is available from Sanyo Kasai Chemical Company. The resulting toner was classified in order to remove particles smaller than 5 microns in diameter.

To 100 parts of the above prepared toner there was added by blending 0.15 parts of zinc stearate, and 0.40 parts by weight of Aerosil R972, prepared by a flame hydrolysis process, and available from Degussa Corporation. Also, to a different 100 parts of the above prepared toner there was added by blending 0.15 parts of zinc stearate, and 0.40 parts by weight of Sipernat D-17, a colloidal silica prepared by a precipitation process, and available from Degussa Corporation. Both of the silicas used were surface treated with the silane compound dimethyl dichlorosilane for the purpose of rendering them hydrophobic.

Thereafter, each of the above toners, 2 parts by weight, were mixed with a carrier, 100 parts by weight, consisting of ferrite core coated with 0.5 percent by weight of a terpolymer of styrene, methacrylate, and vinyl triethoxysilane, resulting in xerographic developer compositions. The triboelectric charges in microcoulombs per gram of the resultant developers were then measured at various relative humidities on a toner charge spectrograph. This instrument dispenses toner particles in proportion to the charge to diameter ratio, and with the aid of automated microscopy, can generate charge distribution histograms for selected toner size classes. The following results were recorded:

| | |
|---|---|
| Toner With Aerosil R972 | |
| 1 hour at 28% RH | −32 microcoulombs per gram |
| 1 hour at 80% RH | −21 microcoulombs per gram |
| Toner With Sipernat D-17 | |
| 1 hour at 28% RH | −27 microcoulombs per gram |
| 1 hour at 80% RH | −21 microcoulombs per gram |

−represents a negative value throughout

There was thus a decrease in toner tribo of only 22.2 percent with the Sipernat D-17 as compared to a much larger decrease of 34.4 percent with the Aerosil R972.

Also, the toner with Aerosil R972 contained therein 3 percent by weight of toner particles with a positive charge, or wrong sign toner, after affecting admixing for 2 minutes as determined by a charge spectrograph; while the toner with the Sipernat D-17 contained therein only 1 percent by weight of toner particles with a positive charge after affecting admixing for 2 minutes as determined by the same charge spectrograph. High concentration of wrong sign toner tends to produce high background, and prints of poor quality.

Specifically, the percentage of wrong sign toner was determined by adding to each of the above prepared developers, 2 percent toner concentration, 1 percent by weight of freshly prepared toner with the same components as toner A followed by roll mixing for two minutes. The charge distribution of the resulting toner was then analyzed on a charge spectrograph, and the amount of wrong sign toner was determined.

Toner concentration latitude data was generated at 20 percent relative humidity for the toner compositions as prepared in Example I, with the following results:

| | Latitude Number |
|---|---|
| With Aerosil R972 | |
| one minute blend time | −0.2% |
| two minute blend time | +0.3% |
| three minute blend time | +1.7% |
| With Sipernat D-17 | |

-continued

| | Latitude Number |
|---|---|
| one minute blend time | +0.3% |
| two minute blend time | +1.5% |
| three minute blend time | +2.8% |

A higher toner concentration latitude number translates into improved performance for the resulting developer composition when selected for use in xerographic imaging processes. Accordingly, a latitude of 1.5 percent indicates the toner concentration in the developer can vary by 1.5 percent without causing unacceptable background in the developed images that are generated. For example, for a developer blending time of 2 minutes, the developer containing Aerosil R972 had a TC latitude of only 0.3 percent, whereas the developer with Sipernat D-17 had a toner concentration latitude of 1.5 percent.

EXAMPLE II

There was prepared a toner composition B with Sipernat D-17 by repeating the procedure of Example I, with the exception that there was used in place of the Black Pearls 1300, Black Pearls L, obtained from Cabot Corporation. Subsequent to tribo determinations, and admixing, this toner had a tribo of −27 microcoulombs per gram after 1 hour; and the percentage of wrong sign toner after 2 minutes of admixing was 1.5 percent.

EXAMPLE III

There was prepared a toner composition C with Sipernat D-17 by repeating the procedure of Example I, with the exception that there was used in place of the Black Pearls 1300, 8 percent of Raven 5750 carbon black, obtained from Cities Service, and 92 percent by weight of resin particles. Subsequent to tribo determinations, and admixing, this toner had a tribo of −29 microcoulombs per gram after 1 hour; and the percentage of wrong sign toner after 2 minutes of admixing was 0.5 percent.

EXAMPLE IV

There was prepared a toner composition D with Sipernat D-17 by repeating the procedure of Example I, with the exception that there was used 8 percent of the Black Pearls 1300, and 92 percent by weight of the resin particles. Subsequent to tribo determinations and admixing, this toner had a tribo of −32 microcoulombs per gram after 1 hour; and the percentage of wrong sign toner after 2 minutes of admixing was b 1.2 percent.

Images can be generated with the developer compositions prepared in accordance with Examples I to IV having incorporated therein the Sipernat D-17. Specifically, thus latent electrostatic images are formed on a selenium photoconductive imaging member present in a xerographic imaging apparatus, followed by developing these images with the developer compositions as prepared in Examples I to IV, and thereafter subsequently transferring the image to a suitable substrate.

Other modifications of the present invention may occur to those skilled in the art based upon a reading of the present disclosure, and these modifications are intended to be included within the scope of the present invention.

What is claimed is:

1. A toner composition consisting essentially of a mixture of first resin particles grafted to or containing a wax, said first particles being different from second particles, and second terpolymer particles, pigment particles, and irregularly shaped oxide particles selected from the group consisting of individual additive particles of silicon oxides, aluminum oxides, and titanium oxides, which particles are prepared by a precipitation process and are of a diameter of from about 10 millimicrons to about 40 millimicrons.

2. A toner composition in accordance with claim 1 wherein the additive particles are present in an amount of from about 0.1 percent by weight to about 5 percent by weight.

3. A toner composition in accordance with claim 1 wherein the additive particles are silicon oxides.

4. A toner composition in accordance with claim 1 wherein the resin particles are comprised of styrene based polymers.

5. A toner composition in accordance with claim 1 wherein the first resin particles are comprised of polystyrene polymers, with a wax of a molecular weight of from about 1,000 to about 10,000; and the second resin particles are comprised of a terpolymer of styrene, methacrylate, and acylonitrile.

6. A toner composition in accordance with claim 1 wherein the first resin particles are comprised of a styrene butylmethacrylate copolymer with polypropylene of a molecular weight of about 5,000.

7. A developer composition consisting essentially of the toner composition of claim 1 and carrier particles.

8. A developer composition in accordance with claim 7 wherein the carrier particles are comprised of a core of ferrites with a coating thereover.

9. A developer composition in accordance with claim 7 wherein the additive particles are silicon oxides.

10. A toner composition in accordance with claim 1 wherein the pigment particles are carbon black.

11. A toner composition in accordance with claim 1 further including therein as second additive particles fatty acid metal salts.

12. A tone composition in accordance with claim 11 wherein the fatty acid metal salt is zinc stearate.

* * * * *